US007326156B2

(12) United States Patent
Dworzan

(10) Patent No.: US 7,326,156 B2
(45) Date of Patent: Feb. 5, 2008

(54) HANDHELD GYROSCOPIC EXERCISE DEVICE

(76) Inventor: William S. Dworzan, 12351 Alexander La., Santa Ana, CA (US) 92709

( * ) Notice: Subject to any disclaimer, the term of this patent is extended or adjusted under 35 U.S.C. 154(b) by 486 days.

(21) Appl. No.: 10/693,338

(22) Filed: Oct. 24, 2003

(65) Prior Publication Data

US 2005/0101454 A1 May 12, 2005

(51) Int. Cl.
*A63B 21/22* (2006.01)
*A63B 23/14* (2006.01)

(52) U.S. Cl. ..... 482/110; 482/44

(58) Field of Classification Search ..... 482/44–50, 482/110; 74/5 R

See application file for complete search history.

(56) References Cited

U.S. PATENT DOCUMENTS 3,489,017 A * 1/1970 Parker ..... 74/5.6 R
3,617,056 A 11/1971 Herbold
3,726,146 A * 4/1973 Mishler ..... 74/5 R
4,150,580 A 4/1979 Silkebakken et al.
4,684,124 A 8/1987 Escher
5,150,625 A 9/1992 Mishler
D350,796 S 9/1994 Pravitz
D351,436 S 10/1994 Pravitz
D351,437 S 10/1994 Pravitz
5,353,655 A 10/1994 Mishler
D365,612 S 12/1995 Pravitz
6,419,544 B1 7/2002 Parker et al.
6,629,908 B2 * 10/2003 Hamady ..... 482/45

OTHER PUBLICATIONS www.dansdata.com; GyroTwister and Powerball description.

* cited by examiner

*Primary Examiner*—Fenn C. Mathew
(74) *Attorney, Agent, or Firm*—Clement Cheng

(57) ABSTRACT

A gyroscopic exercise device has a pair of handles attached to a housing. A user holds and rotates the handles along a cone-like path causing precession of a rotor, which is rotating about its spin axis, to provide resistance to the user. The device has a ring guide that holds ends of a shaft, which is coupled to the rotor. The periphery of the ring guide and the ends of the shaft are within a circular race defined by the housing. A motor attached to the ring guide drives a wheel that rotates the rotor about a spin axis by using energy provided by batteries in one of the handles. The energy passes through a conducting conduit that rotates about the precession axis. The ring guide, motor, and rotor can rotate together during precession of the rotor.

4 Claims, 12 Drawing Sheets

HANDHELD GYROSCOPIC EXERCISE DEVICE

BACKGROUND OF THE INVENTION

1. Field of the Invention

This invention relates in general to exercise devices and particularly to handheld exercise devices that have a gyroscope.

2. Description of the Related Art

Exercise machines can be used to improve an individual's overall health, e.g., by using exercise machines for resistance training and cardiovascular training. Resistance training, among other things, can improve the individual's health by increasing endurance, muscle mass and strength, tendon strength, ligament strength, and bone density. Typically, resistance training involves using resistance equipment that provides unidirectional resistance because resistance equipment (such as a bench or military press equipment, universal machines, barbells, and dumbbells) relies on gravity for resistance. Unfortunately, the resistance equipment may be large, cumbersome and heavy, thereby making transportation difficult. Thus, resistance equipment is typically located in gyms and may also require that two people participate in the activity, especially when an individual uses free weights. For example, the individual performing a press on the bench press may require a spotter. If the individual performing the press cannot adequately lift the weight, the spotter can help lift the weight.

Many conventional resistance machines have a cable that is attached to a weight. The user pulls the cable to displace the weight and resistance is provided by gravity acting on the weight. Unfortunately, the cable resistance machines provide resistance only for a pulling motion. Typically, the conventional cable resistance machines have a stack of weights and the user can select a portion of the stack of weights that are attached to the cable. Thus, during the pulling motion, the resistance to the user is reasonably constant because the user must overcome a gravitational force which is directly related, typically, to the constant mass of the pre-set weight attached to one end of the cable.

There are also handheld devices for resistance training. For example, a handheld ball (e.g., a tennis ball) can be squeezed to increase gripping strength. Some handheld devices have a spring that provides resistance, such as a handgripper that has a spring which provides resistance to the user when user grips and then squeezes the handgripper. Unfortunately, the spring may provide a reasonable constant resistance to the user. Additionally, these handheld devices are capable of limited ranges of resistance and may target very specific muscle groups, such as muscles related to gripping strength.

Cardiovascular training can be performed, e.g., by using stationary cardiovascular equipment. For example, the user can use stationary cardiovascular equipment (such as a treadmill, stepper, elliptical machine, or stationary bike), which is typically located in a gym. Unfortunately, stationary cardiovascular equipment can be cumbersome and heavy thereby making transportation difficult. Also, similar to resistant equipment, some stationary cardiovascular equipment cannot be used in many locations because of size limitations. For example, conventional treadmills cannot be used in small rooms or offices. Thus, many conventional stationary equipment machines are designed for use in either a gym or large room.

Cardiovascular training can also be performed by the running, walking, jogging, or riding a bike. Typically, these forms of exercise can require that the individual be capable of using their legs and have adequate climate conditions. Unfortunately, many people cannot do these exercises because of problems with their legs (e.g., arthritis in the knee). Additionally, many climates are not suitable for outdoor cardiovascular training. For example, people may not exercise in extreme environments, such as summer time in the desert or in cold environments.

Accordingly, there exists a need for an improved exercise device.

SUMMARY OF THE INVENTION

There is provided in accordance with one embodiment of the present invention a gyroscopic exercise device having a housing with an annular path. Handles are coupled to opposite sides of the housing perpendicular to the path. A rotatable shaft is coupled to a rotor and has ends that are mounted to move in the annular path. The handles are configured so that moving the handles in a cone-like motion causes precession of the rotor.

In one embodiment, the housing defines a circular path for the ends of a shaft. The circular path and the axis of the shaft define a plane. A power supply, such as a battery, positioned in one of the handles and a motor to rotate the shaft is coupled to a ring guide, which is slidably coupled to the housing. Further, one of the handles preferably supports a switch to control the energy from the power supply to the motor.

In accordance with a method of the invention, the rotor rotates about a first axis defined by the shaft and about a second axis, which is perpendicular to the first axis, by moving the handles along orbital paths. The motor rotates the rotor about the first axis, and the motor itself rotates about the second axis as the handles travel along the orbital paths.

In one embodiment, power from a battery in one of the handles is transmitted from a pair of fixed conductors to a pair of conductive contacts that rotate connected to the motor. In a preferred arrangement, one of the fixed conductors has a tubular shape and surrounds an insulator and the other fixed conductor.

The rotor is a gyroscopic inertia wheel that has a drive race and an axis of spin. A motor driven wheel contacts the drive race, which rotates about the axis of spin.

In another embodiment, the motor is configured so that, when energized from the power source, it causes the inertia wheel to rotate for a start-up cycle so that the inertia wheel spins at an operational velocity. After the start-up cycle, the motor generates a feedback voltage. The feedback voltage can be used to illuminate an LED or a plurality of LED's. The feedback voltage can recharge the power source including a rechargeable battery.

In one embodiment, the shaft has a tapered roller drive pinion at both ends. The tapered roller drive pinions engage the circular race and have two surfaces configured to mate with the race surfaces. In a preferred embodiment, the ring guide has a radially tapered periphery with a first guide surface and second guide surface. The first guide surface is substantially parallel to the first surface of the circular race and the second guide surface is substantially parallel to the second surface of the circular race. The radially tapered periphery can slide along the circular race, and the surface of one of the tapered roller drive pinions has two diametrically opposing portions. One of the portions is substantially parallel to the first surface of the circular race and the other portion is substantially parallel to the second surface of the circular race. In one embodiment, the housing has a race insert that defines the annular race.

In one embodiment, the switch to energize the motor is conveniently located at one end of the handle attached to the housing.

In one embodiment, a bearing pad is rotatably coupled to the shaft. The ring guide has diametrically spaced notches to receive the bearing pad, which is between the ring guide and the side of the shaft.

In one embodiment, the ring guide has a circular shaped outer periphery and an integral inner platform. The motor can be mounted to the platform so that the motor can rotate the rotor. In a preferred embodiment, the ring guide defines a plane and has a substantially uniform thickness.

In one embodiment, the housing includes a pair of intersecting rings that are substantially perpendicular to each other. The pair of handles is attached at opposite ends of one of the rings. The shaft is rotatably, slidably mounted to the other ring. A generally spherical cover can fill the openings between the pair of rings.

DETAILED DESCRIPTION OF THE PREFERRED EMBODIMENT

Figure 1:
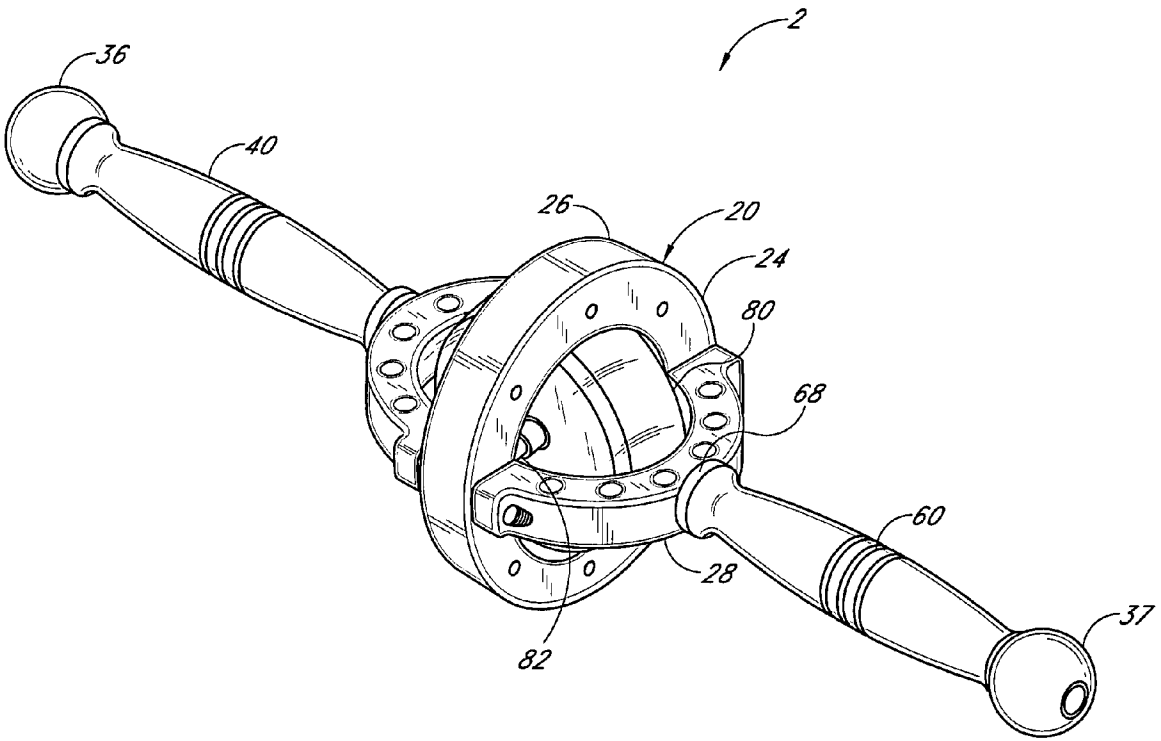
FIG. 1 is a perspective view of a gyroscopic exercise device in accordance with the present invention.
Figure 1A:
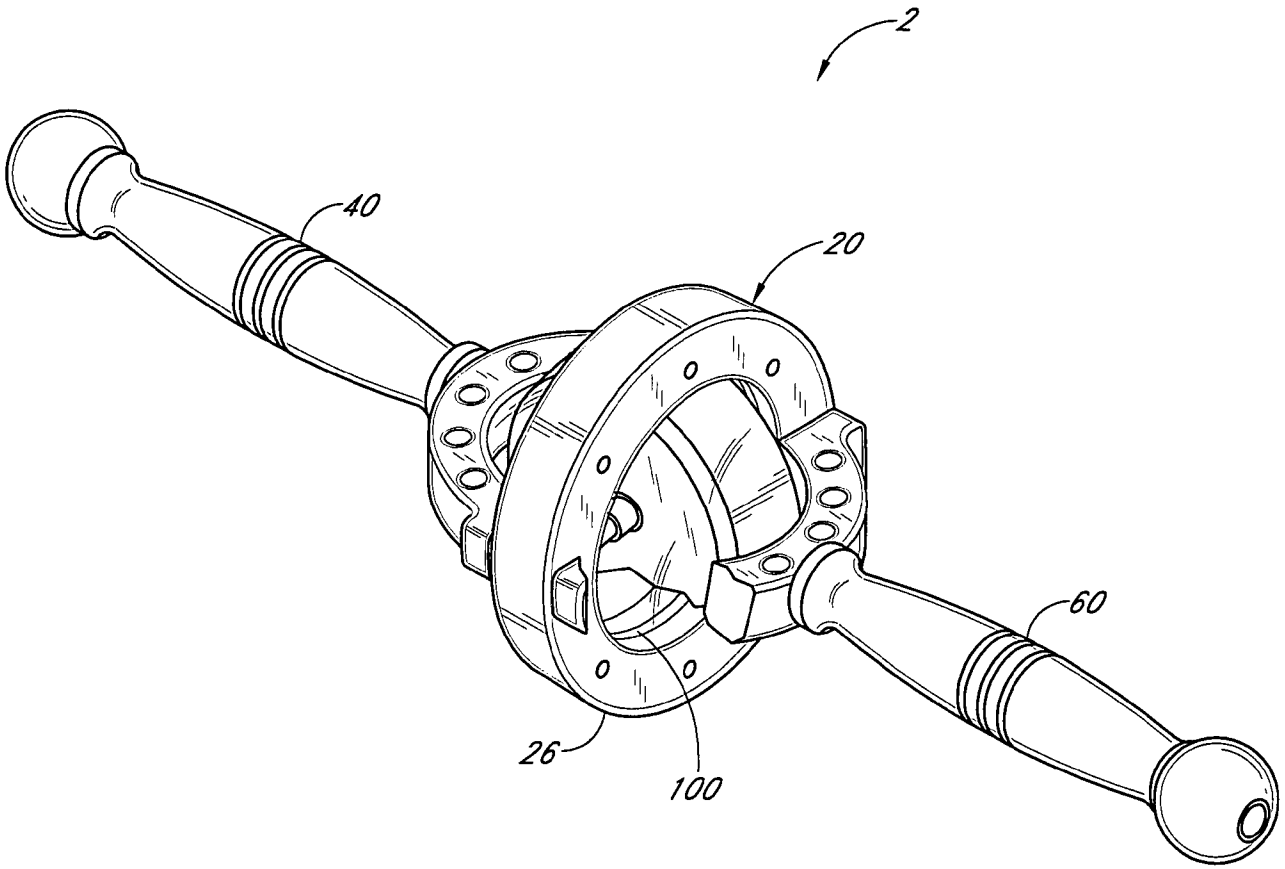
FIG. 1A is a perspective view of a gyroscopic exercise device with a portion removed to show a ring guide in accordance with the present invention.

FIG. 1 is perspective view of a gyroscopic exercise device 2 incorporating the invention. The gyroscopic exercise device 2 illustrated comprises a housing 20 having a frame 24 formed by a pair of rigid rings 26 and 28 that generally define planes that are perpendicular to each other. A pair of handles 40 and 60 are attached to opposite sides of the ring 28. A wheel or rotor 80 is coupled to a shaft 82, which is rotatably coupled to a ring guide 100 and the housing 20. More specifically, the ends of shaft 82 are rotatably mounted in the ring guide 100 (as shown in FIG. 1A) which includes a ring shape periphery and is mounted within the ring 26. The ring guide 100 in effect captures the ends of the shaft 82 while permitting them to rotate about the shaft axis; but at the same time the ring guide 100 can rotate within the ring 26 in a plane perpendicular to an axis 104 that extends through the handles 40 and 60.

Figure 2:
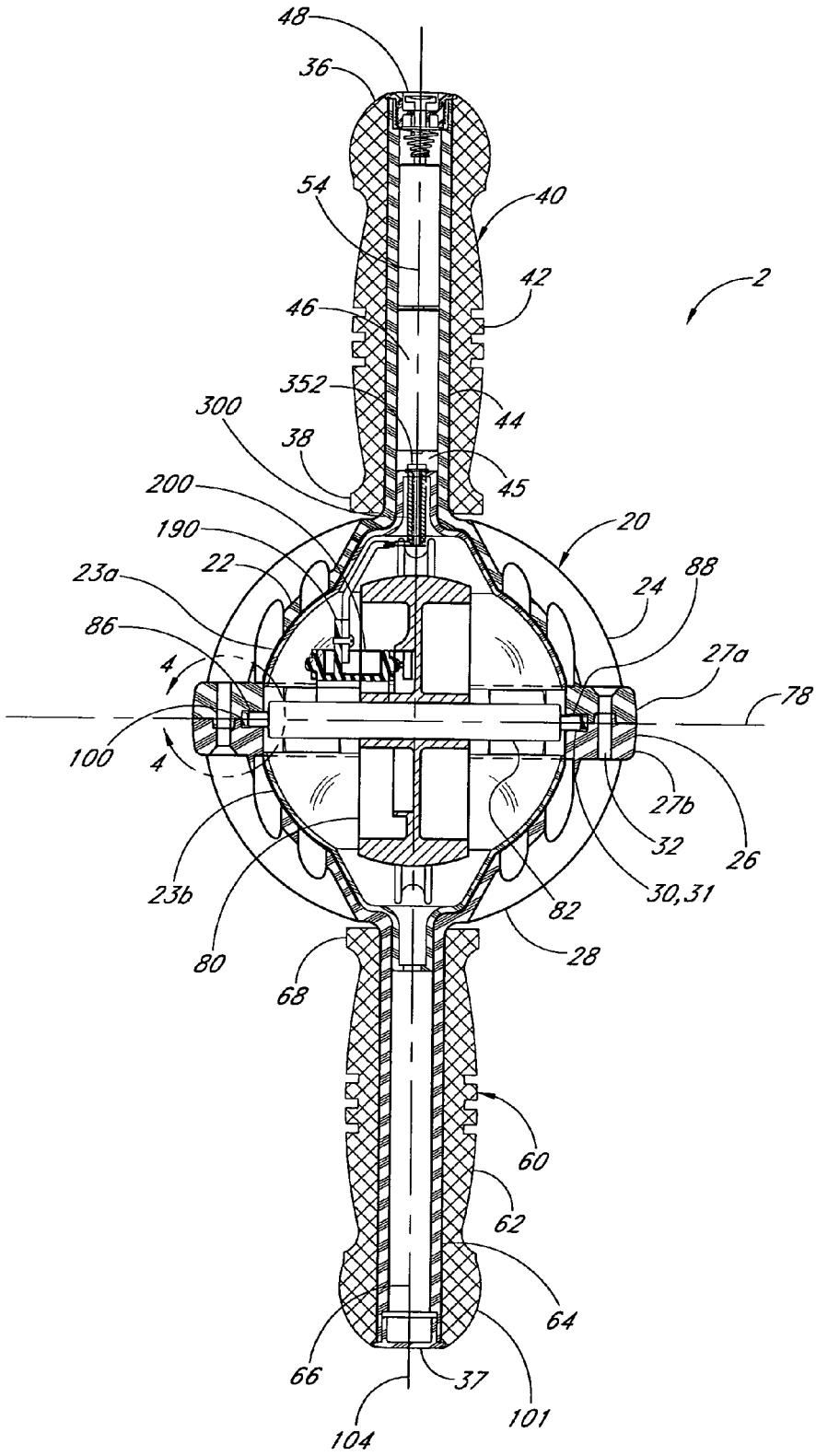
FIG. 2 is a cross-sectional view of a gyroscopic exercise device in accordance with the present invention.

As seen in the cross-sectional view of the gyroscopic exercise device 2 in FIG. 2, the device 2 has a power supply 46 in the form of a pair of batteries positioned within a cylindrical chamber 45. The handle 40 has an inner end 38 that is coupled to the housing 20 and a tubular handle outer portion 42, which surrounds a cylindrical inner handle portion 44 defining the chamber 45. In the illustrated embodiment, the power supply 46 is located within the chamber 45, which has a switch 48 at one end and a contact 352 at the other end. The switch 48 is located at an outer end of the chamber 45 and connected to the power supply 46 so that the user can activate (e.g., manually or automatically) the switch 48 to provide power to a motor 200 forming part of a drive assembly 190. The handle inner portion 44 is made of a rigid material such as metal, plastic or the like while the outer portion 42 has a thickness that varies along its longitudinal axis 54 and is made of a cushioning material to facilitate gripping and is shaped to conveniently fit the hand of a user.

The handle 60 has a tubular handle outer portion 62 surrounding a cylindrical handle inner portion 64. The handle 60 has an inner end 68 and an outer end portion 37. In the illustrated embodiment, handle outer portion 62 has a thickness that varies along its longitudinal axis 66 and is made of a cushioning material to facilitate gripping and is shaped to conveniently fit the hand of a user. The handle 40 is diametrically opposed to the handle 60 and the longitudinal axis 54 and the longitudinal axis 66 are coaxial. The handles 40 and 60 are coupled to the housing 20 so that the user can rotate the device 2, and are also equidistant from the shaft 82. Those skilled in the art will recognize the inner portion 64 and the inner portion 44 can be coupled to the housing 20 in various manners. In one embodiment, for example, the inner portions 44 and 64, and the frame 24 of the housing 20 can be a unitary body formed by a molding process, such as injection molding. In another embodiment, a plurality of couplers (e.g., screws or bolts) couple the inner portions 44 and 64 to the housing 20. In another embodiment, the handle inner portions 44 and 64 are metal (e.g., aluminum), and are welded to the housing 20. In another embodiment, the handles 40 and 60 are threadably coupled to the housing 20. The housing 20 has two threaded holes, and the inner portions 44 and 64 have threads that are received in the threaded holes in the housing 20.

The handle outer portions 42 and 62 are preferably formed from a material that can be comfortably gripped by the user, such as foam, rubber, plastic, metal, or the like. In the illustrated embodiment, handle outer end portions 36 and 37 are generally spherical to minimize risk of injury to the user if the user gets hit by a handle end. Of course, the outer end portion 36 allows access to the switch 48, such that the user can activate the switch 48 to provide power to the motor 200. In one embodiment, the outer end portion 36 is visually different from the outer end portion 37. For example, the outer end portion 36 can be a different color or shape than the outer end portion 37 to indicate the location of the switch 48.

The housing 20 comprises a cover 22 and the frame 24. The cover 22 has a generally spherical shape with a diameter greater than the diameter of rotor 80 and forms a chamber for the rotor 80 and the shaft 82 and covers openings in the frame 24 (e.g., openings between the rings 26 and 28). The cover 22 comprises a first portion 23A and a second portion 23B, each portion being hemispherical in shape. In the illustrated embodiment, the first portion 23A extends from the handle 40 to the ring 26 and the second portion 23B extends from the handle 60 to the ring 26. Fasteners or adhesives can be used to attach the cover 22 to the frame 24. The cover 22 is formed of materials that prevent objects from contacting moving parts within the housing 20. Preferably, the cover 22 is formed or molded from material (e.g., styrene or acrylic plastic) that permits the user to view chamber within the cover 22. Those skilled in the art recognize that the cover 22 can also be made of other materials, which cannot be seen through, and can be any color. Because the cover 22 covers gaps or openings in frame 24, the cover 22 can prevent the individual's clothing or hair form being wound around the shaft 82. The cover 22 can also prevent individual's skin from being pinched, for example, between either the rotor 80 and the ring 26 or the rotor 80 and the ring 28.

The frame 24 houses the rotor 80 and is coupled to the pair of handles 40 and 60. In the illustrated embodiment, the frame 24 has the rings 26 and 28, which diametrically intersect and are orthogonal to each other. The ring 26 and the ring 28 are rings with substantially similar diameters and have a substantially rectangular cross-sectional profile. The frame 24 can be formed by machining (e.g., by using a CNC machine) or a molding process, and can be made from metal, ceramic, plastic, or the like.

The ring 26 comprises a first ring portion 27A coupled to a first ring portion 27B. In the illustrated embodiment, the first ring portion 27A and the first ring portion 27B are configured to mate to form the ring 26. A plurality of fasteners 32 couple the mated first ring portion 27A and first ring portion 27B such that the ring 26 is an integral structure.

The frame 24 can be coupled to the handles 40 and 60. In the illustrated embodiment, the pair of diametrically opposed handles 40 and 60 are coupled to opposite sides of the ring 28. Those skilled in the art recognize that the handle 40 and the handle 60 can be coupled to the housing 20 at various locations because the user can properly rotate the device 2 when, for example, the handle 40 and the handle 60 are coupled to the ring 26. Thus, the longitudinal axis 54, the longitudinal axis 60, and a circular race 31 can be in one plane.

Figure 3:
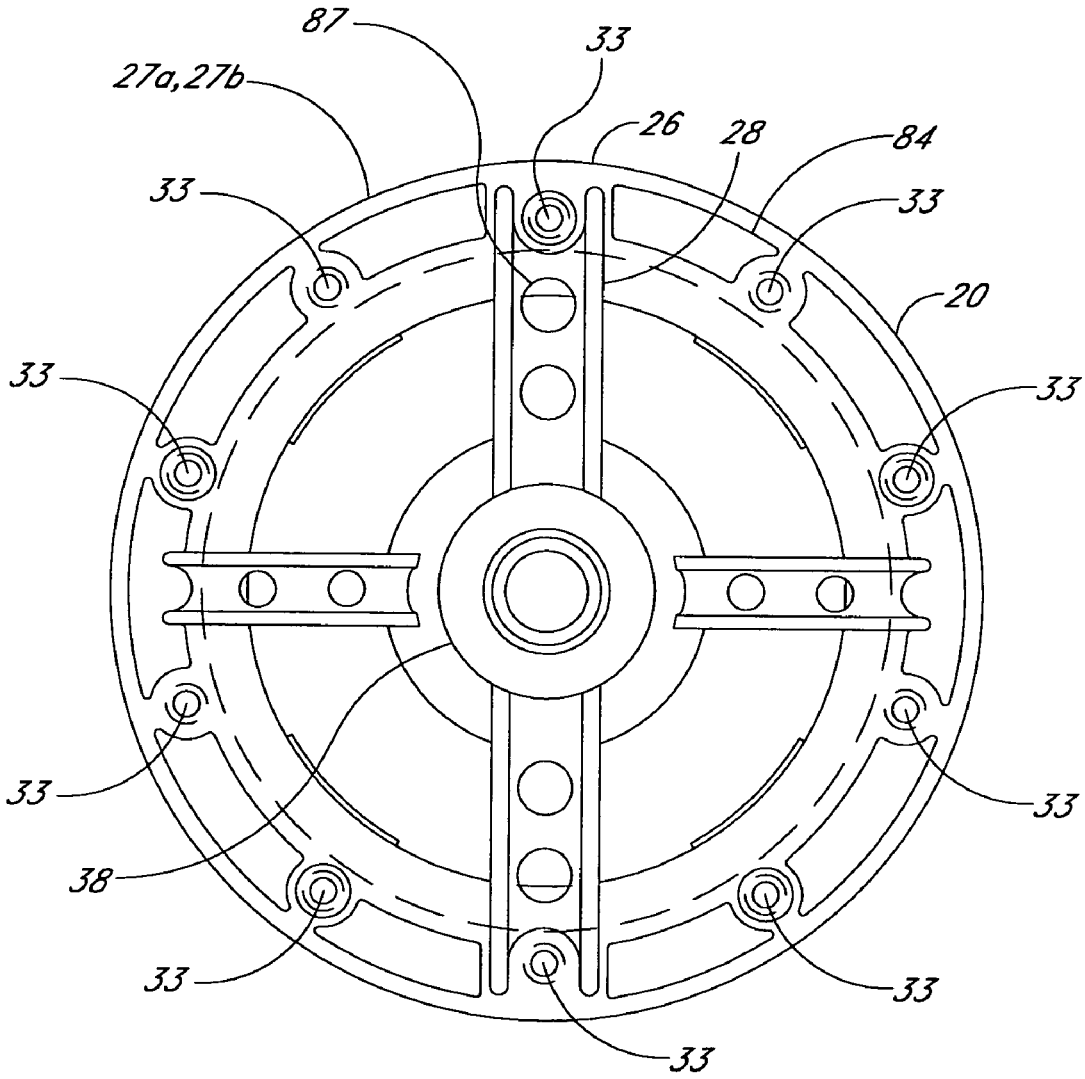
FIG. 3 is a side view of a housing of a gyroscopic exercise device in accordance with the present invention.

FIG. 3 illustrates the ring 26 having a plurality of holes, one of which is fastener hole 33, which pass through both the first ring portion 27A and the first ring portion 27B. The plurality of fasteners 32 (shown in FIG. 2) fit into the plurality of fastener holes 33 to couple together the first ring portion 27A and the first ring portion 27B. For example, the plurality of fastener 32 can be screws and the plurality of fastener holes 33 can have threads. The fastener 32 can be screwed into the plurality of fastener holes 33 to couple together the first ring portion 27A and the first ring portion 27B. Those skilled in the art recognize that the fastener 32 can be a screw, pin, bolt, or the like. The ring 26 can have cut outs 84 to reduce the weight of the device 2 and is attached to four curved frame members. The four curved frame members have holes 87 to reduce the weight the device 2 and are attached to a one of the handles. Of course, the ring 26 illustrated in FIG. 1 does not have the cut outs 84 or the four curved frame members.

As shown in FIG. 2, circumferentially located on the inner portion of the ring 26 is the circular race 31 forming an annular path that is concentric and orthogonal to the axis 104. Preferably, the circular race 31 is located at the equator of the housing 20 and is a track that holds the ring guide 100 and shaft ends 86 and 88. The shaft 82 can rotate about the spin axis 78 and its ends can travel along the circular race 31, while the circular race 31 prevents the displacement of the shaft ends 86 and 88 along the 104 axis. There is also rolling contact between both the shaft ends 86 and 88 and the circular race 31, which is formed by the first ring portion 27A and the first ring portion 27B and has surfaces that slidably engage with the ring guide 100. Thus, the periphery of the ring guide 100 can slide within the circular race 31, thereby rotating the ring guide 100 about the axis 104 while inhibiting motion of the ring guide 100 along the axis 104 relative to the circular path 31.

Figure 4:
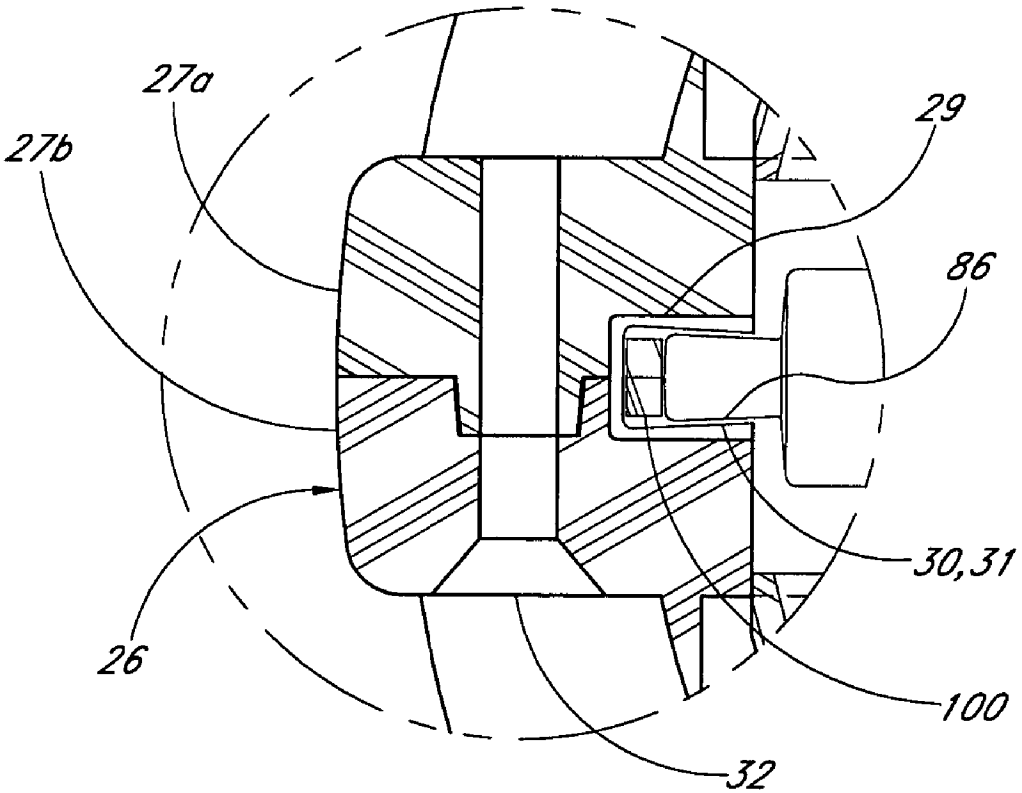
FIG. 4 is an enlarged cross-sectional view of a ring for a gyroscopic exercise device in a further embodiment of the present invention.

FIG. 4 shows a race insert 29 between the ring guide 100 and the ring 26. The outer surfaces of the race insert 29 contact the ring 26 while the inner surfaces of the race insert 29 form the circular race 31. The race insert 29 can have various cross-sectional profiles, such as a substantially U-shaped cross-sectional profile as illustrated. Although not illustrated, the race insert 29 can have a V-shaped cross-sectional profile, or the like, that can engage with the ring guide 100 and the ring 26. After the race insert 29 is worn, the race insert 29 can be replaced so that both the ring guide 100 and the shaft 82 can travel smoothly along the circular race 31 of the race insert 29.

In the illustrated embodiment, the race insert 29 can be replaced by removing the fasteners 32 and separating the first ring portions 27A and 27B. The race insert 29 comprises two portions, with each portion of the race insert 29 attached to the ring 26. For example, the first portion of the race insert 29 is attached to the first ring portion 27A. After the first portion of the race insert 29 is attached to the first ring portion 27A, the shaft ends 88 and 86 are placed in the first portion of the race insert 29 so that the sides of shaft end 88 and end 86 contact the first portion of the race insert 29. The second portion of the race insert 29 can be attached to the first ring portion 27B, which is then coupled to the first ring portion 27A, such that the shaft end 86 and the shaft end 88 are located in the circular race 31. The race insert 29 can be made of a wear resistant material which provides traction for the rotation of the rotor 80, such as a ceramic or metal (e.g., titanium, steel, or aluminum).

Figure 5:
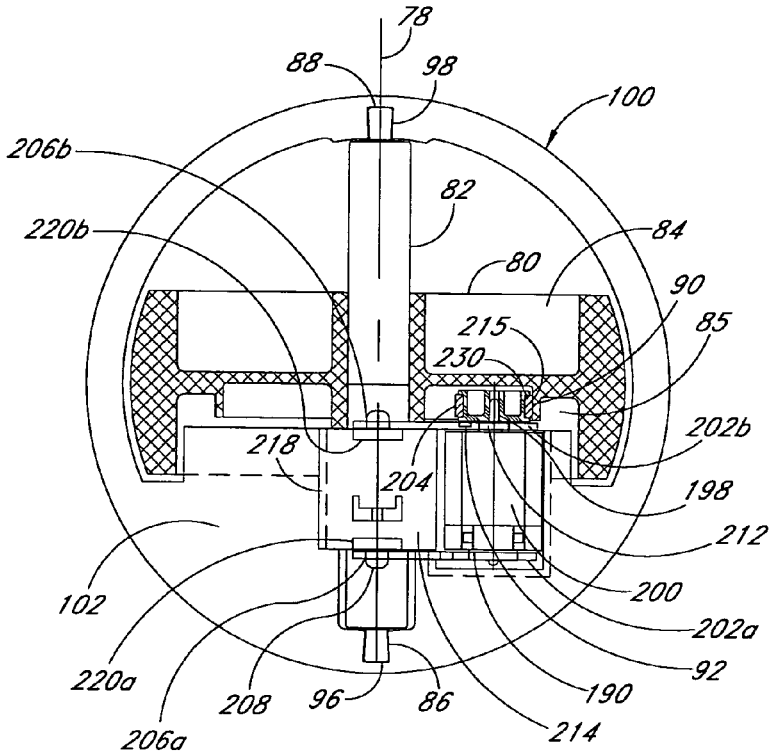
FIG. 5 is a partial cross-sectional view of a ring guide and a drive assembly of a gyroscopic exercise device of the present invention.

FIG. 5 shows the ring guide 100, the drive assembly 190, and a rotor 80 coupled to shaft 82 preferably midway between the shaft ends 86 and 88. The shaft ends 86 and 88 are shaped and sized to fit into the circular race 31. Thus, the shaft ends 86 and 88 can be shaped similar to the circular race 31 to promote smooth travel of the ends 86 and 88 along the circular race 31, while also allowing the shaft 82 to freely rotate about its spin axis 78. In the illustrated embodiment, the shaft 82 is cylindrical, and the shaft ends 86 and 88 have a diameter less than the diameter of a middle portion of shaft 82.

The shaft 82 is rotatably coupled to the ring guide 100. The ring guide 100 is sized so that its outer periphery can be within the circular race 31 and has diametrically opposed notches 98 and 96 on its inner periphery. The shaft end 86 is disposed within the notch 96 while the shaft end 88 is disposed within the notch 98. The ring guide 100 is between the circular race 31 and both the shaft end 86 and the shaft end 88 so that the ring guide 100 prevents contact between the ends of shaft 82 and the circular race 31. The notch 96 is shaped similar to the shaft end 86, and the notch 98 is shaped similar to the shaft end 88, thereby allowing the shaft 82 to freely rotate about the spin axis 78. If one side of the notchs 96 and/or 98 becomes worn from the ends 86 and/or 88, respectively, the ring guide 100 can be reversed by rotating the ring guide 100 180 degrees about the axis perpendicular to the axis 104.

As the shaft ends 86 and 88 travel along the circular race 31, the ring guide 100 will rotate about the axis 104 because the notches 96 and 98 will also travel along the circular race 31. In one embodiment, the outer periphery of the ring guide 100 has a substantially uniform thickness and smooth surfaces so that the periphery of the ring guide 100 can smoothly slide within the circular race 31. The width of the ring guide 100 can be approximately the same as both the diameter of the shaft end 86 and the diameter of the shaft end 88. Preferably, the ring guide 100 will be formed from a material, such as metal or plastic, that can smoothly slide along circular race 31 and prevent wear. Of course, the entire ring guide 100 can have a uniform thickness. Similarly, the circular race 31 can be formed from a material, such as a metal or plastic, to substantially reduce the wear between the circular race 31 and the ring guide 100. Additionally, the ring guide 100 and the circular race 31 can be can be formed from different materials. For example, the circular race 31 can be can formed from a metal while the ring guide 100 can be formed from a plastic.

The rotor 80 is an inertia wheel or disk that is shaped and sized for a desired moment of inertia. Preferably, the rotor 80 has a substantial portion of its mass at its outer circumference and its centroid located near the intersection of the spin axis 78 and the axis 104. For example, the rotor 80 can have a recessed annular region 84 and a recessed annular region 85. In the illustrated embodiment, the recessed annular region 84 has a substantially rectangular profile while the recessed annular region 85 has a substantially rectangular profile with a drive race 90 protruding into the recessed annular region 85. The drive race 90 is a circular track that is concentric with the outer surface of the shaft 82 and provides a contact surface to contact a drive wheel 204. Thus, the periphery of the rotor 80 is thicker than the inner portion of the rotor 80 between the recessed annular regions 84 and 85. Those skilled in the art recognize that the rotor 80 can have other shapes, such as a disk with a uniform thickness, can be made from aluminum, steel, nickel, brass, plastic, and the like. Preferably, the rotor has a weight in the range of 0.225 kg to 0.675 kg and a diameter in the range of 9 cm to 16 cm. The rotor 80 and the shaft 82 can be a unitary body, for example, the rotor 80 and the shaft 82 can be machined from a single piece of metal. Alternatively, the rotor 80 can have a hole for receiving the shaft 82. The shaft 82 can pass through a hole in the rotor 80 and a pin or screw can couple the shaft 82 to the rotor 80.

Figure 6:
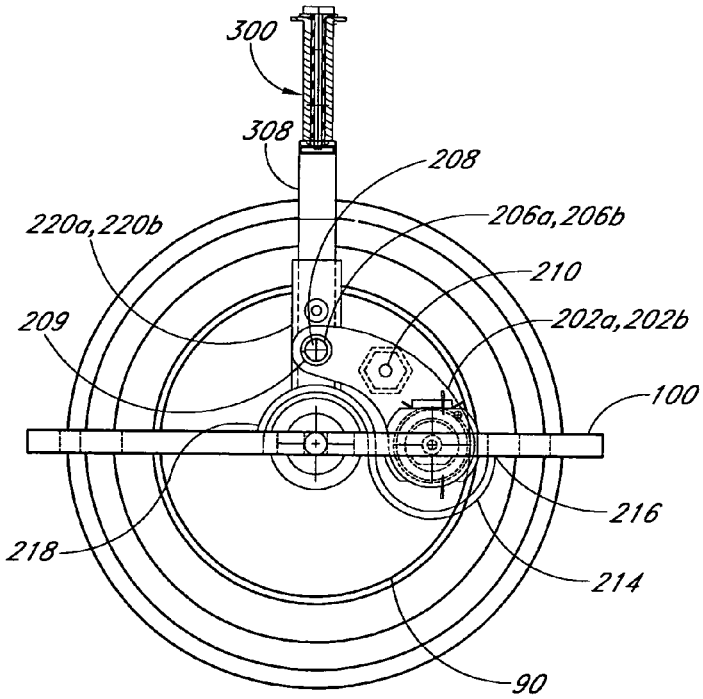
FIG. 6 illustrates the ring guide and the drive assembly shown in FIG. 5.

Referring to FIGS. 5 and 6, the drive assembly 190 comprises the motor 200, which is coupled to motor mounts 202A and 202B and drives a motor shaft 198. The motor mount 202A has a hole 206A and an LED 210, and is coupled to one end of the motor 200. The motor mount 202B has a hole 206B and a motor shaft hole 212. A motor mount shaft 208 passes through and is rotatably coupled to the hole 206A and the hole 206B. The motor shaft 198 passes through and extends out of the motor shaft hole 212, which is sized so that the motor shaft 198 can freely rotate, and is coupled to the drive wheel 204. In the illustrated embodiment, the motor shaft 198 is parallel to the axis 78 and the drive race 90. Thus, one end of the motor shaft 198 is connected to the motor 200 and the other end is connected to the drive wheel 204.

The drive wheel 204 is between the motor shaft 198 and the drive race 90. Preferably, the rim of the drive wheel 204 is compressed between the motor shaft 198 and the drive race 90 in order to increase friction between the drive race 90 and the drive wheel 204 thereby inhibiting slipping. Thus, the drive wheel 204 can rotate causing the drive race 90 to rotate, thereby causing the rotor 80 to rotate. The drive wheel 204 can have a tread 215 made of a material, such as rubber or plastic, that has sufficient coefficient or friction to rotate the rotor 80. The tread 215 surrounds a rim 230, which is coupled to the motor shaft 198, and provides traction between the drive race 90 and the drive wheel 204.

Although not illustrated, the drive race 90 can be formed of material that has a sufficient coefficient of friction so that the drive wheel 204 can rotate rotor 80 without substantial slipping between the drive wheel 204 and the drive race 90. For example, the drive race 90 can be a layer of a plastic or rubber attached to the rotor 80 and disposed between the drive wheel 204 and the rotor 80.

In one embodiment, the motor mount holes 206A and 206B are rotatably coupled to the shaft 208 so that motor mounts 202A and 202B rotate relative to the motor mount shaft 208. For example, the motor mounst 202A and 202B are rotatably coupled to the motor mount shaft 208 and a spring 209 or other device can provide a force that causes contact, and prevents slipping, between the drive wheel 204 and the drive race 90.

A bracket 214 is coupled to the ring guide 100 and holds the drive assembly 190. In the illustrated embodiment, the bracket 214 is coupled to the motor mount shaft 208 and is between the motor mounts 202A and 202B. The bracket 214 has both an end 216 and 218 that are attached to a platform 102. The motor mount shaft 208 passes through a portions 220A and 220B of the bracket 214. A conductive contact 308 can be coupled to the bracket 214. For example, the conductive contact 308 can be coupled to the portion 220A. The bracket 214 can be S-shaped so that the bracket allows the rotation of the shaft 82 about the spin axis 78 and the rotation of the motor 200 about the motor mount shaft 208. The ring guide 100, bracket 214, the drive assembly 190, the rotor 80, the shaft 82, and the conductive contact 308 can rotate together about the axis 104 during precession of the gyroscope.

In the illustrated embodiment, the electric motor 200 is a DC motor because the power supply 46 is a pair of batteries. The motor 200 has sufficient output to rotate the rotor 80 to an operational angular velocity. Alternatively, the motor 200 can be an AC motor if the power supply 46 is an AC power source. Although not illustrated, the outer end portion 36 could have an AC plug connected to wires that are in connected to a power supply conduit 300 (shown in FIG. 10). In one embodiment, the motor 200 can rotate the rotor 80 and generate electricity. The motor 200 receives electricity from the power supply 46 and provides a moment to the motor shaft 198. The motor 200 also generates electricity from the user driven rotation of rotor 80.

In operation, the user rotates the device 2 causing precession and rotation of rotor 80 about the spin axis 78. The drive wheel 204 maintains contact with the drive race 90 of the rotor 80, and thus the drive wheel 204 rotates as the rotor 80 spins about the spin axis 78. Of course, the motor shaft 198 rotates as the drive wheel 204 rotates. The motor 200 converts the rotational movement of the motor shaft 198 into an output, such as an electrical current, that is proportional to the angular velocity of the rotor 80 about the spin axis 78. This electrical current can be used to recharge the power supply 46 or illuminate an LED. For example, the electrical current can be feed back to power supply 46 in the form of a rechargeable battery. Those skilled in the art recognize that the motor 200 can be a conventional brushless motor/generator. These conventional motors, e.g., can have a magnet rotor and stationary winds or stator.

The device 2 can inform the user of the angular velocity of the rotor 80. As illustrated in FIG. 6, the LED 210 is mounted on the motor mount 202A and indicates the rotor's rpm measured by a velocity sensor 92 (shown in FIG. 5). For example, when the rotor 80 rotates at a desired angular velocity, the LED 210 lights up to inform that user that the rotor 80 has achieved the desired angular velocity. The LED 210 can be a plurality of LED's, each LED can correspond to an angular velocity of the rotor 80 and can be a different color than the other LEDs. For example, there can be a red LED, yellow LED, and green LED. The red LED lights up when the rotor 80 achieves an angular velocity of 3,600 rpm. The yellow LED lights up when the rotor 80 achieves an angular velocity of 2,400 rpm. The green LED lights up when the rotor 80 achieves an angular velocity of 1,200 rpm. In one embodiment, there is the LED 210 to indicate to the user when the power supply 46 has supplied enough power to the motor 200 so that rotor 80 reaches a operational angular velocity, such that the user can easily rotate the device 2 for rotor 80 precession. Those skilled in the art recognize that the LED 210 can also be located on the housing 20, the handle 40, or the handle 60. The LED 210 can be powered by either the power supply 46 or the motor 200 in the form of a motor/generator, as discussed above.

Figure 7:
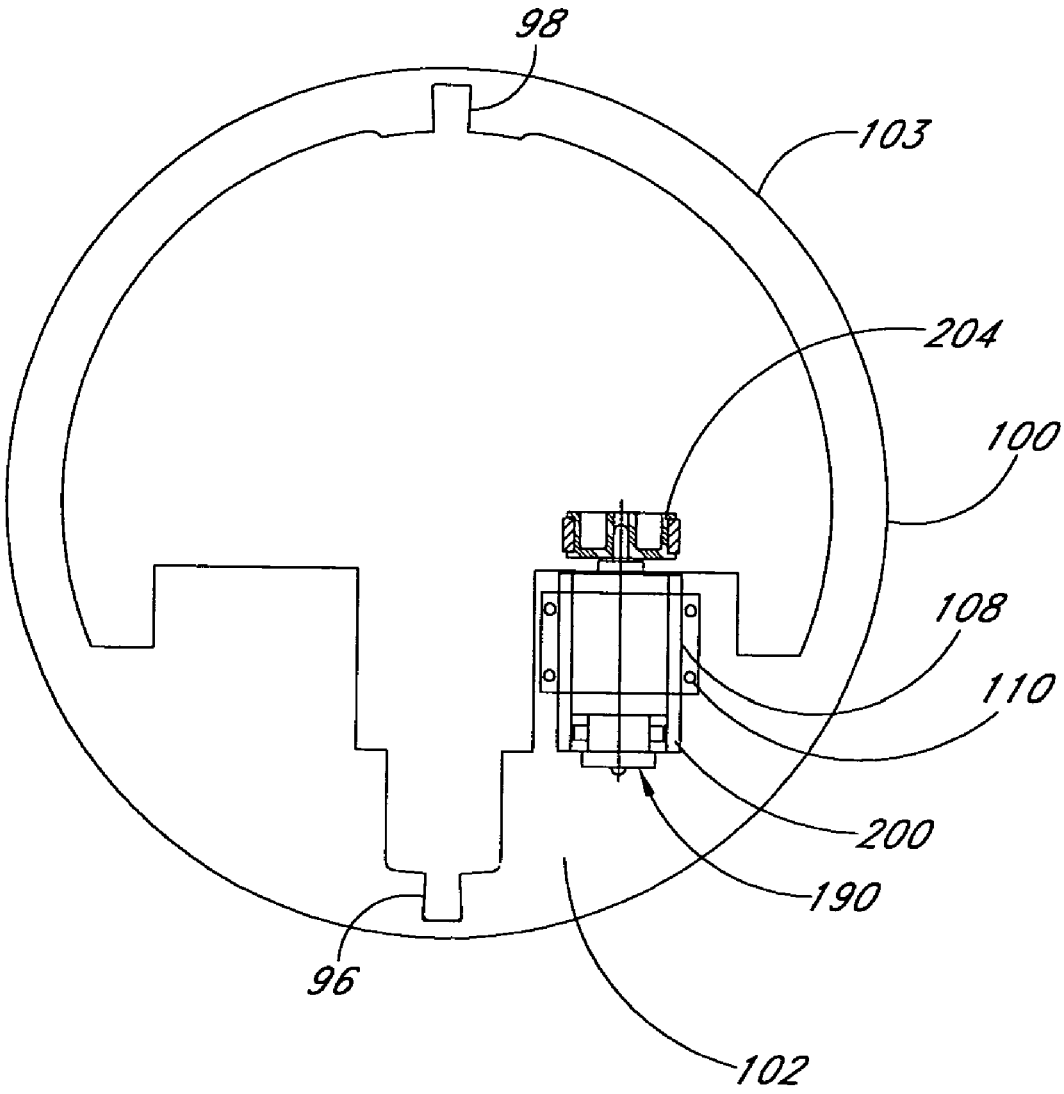
FIG. 7 illustrates a ring guide and a drive assembly in a further embodiment of the present invention.

FIG. 7 shows the drive assembly 190 coupled to the ring guide 100. Preferably, the ring guide 100 has an outer ring portion 103 and the platform 102 that are integrally formed and define a plane. The platform 102 extends inwardly from the outer ring portion 103 and moves with the motor 200 while permitting rotation of rotor 80. In the illustrated embodiment, the bracket 108 is attached to both the platform 102 and the motor 200 by a plurality of fasteners 110 (e.g., screws or bolts). In another embodiment, the motor 200 may have mounting structure, such as housing with holes or openings, so that the motor 200 can be attached directly to the ring guide 100. Fasteners extending through the holes in the housing of the motor attach the motor 200 to the ring guide 100. Thus, the motor 200 can rotate the drive wheel 204 to rotate the rotor 80, while the motor 200 is not displaced relative to the ring guide 100. The motor 200, of course, is coupled to the ring guide 100 in a position so that the drive wheel 204 can rotate the rotor 80.

Figure 8:
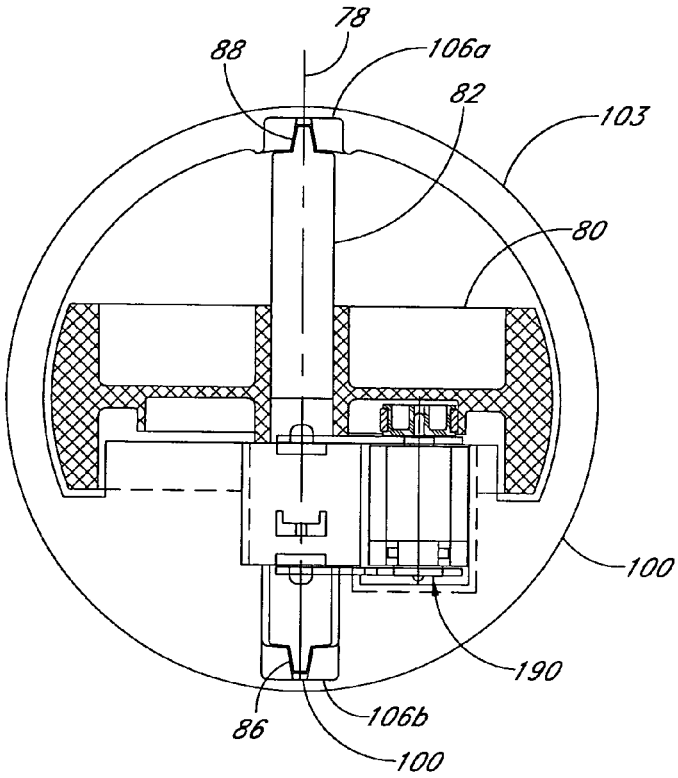
FIG. 8 is a partial cross-sectional view of a shaft having tapered ends mounted in a ring guide and bearing pads in accordance with the present invention.

FIG. 8 is a view of the ring guide 100, the shaft 82, the motor 200, and a portion of the rotor 80. In the illustrated embodiment, the shaft ends 86 and the 88 are tapered or frusto-conical and engage with a groove 30, i.e., the circular race 31. The circular race 31 is similarly angled so that the both the shaft ends 86 and 88 can smoothly pass along the circular race 31 while the shaft 82 rotates about the spin axis 78. In one embodiment, the shaft ends 86 and 88 are tapered roller drive pinions, each having a surface that mates with the circular race 31. The ring guide 100 can have a radially tapered periphery to fit within the circular race 31 and can have a first surface 120 and a second surface 122.

The ring guide 100 can have a bearing pad 106A and a bearing pad 106B. The bearing pad 106A is between the ring guide 100 and the side of the shaft end 88, and the bearing pad 106B is between the ring guide 100 and the side of the shaft end 86. In one embodiment, the bearing pads 106A and 106B are made of a different material than ring guide 100. The ring guide 100 can be formed of a material so that the ring guide 100 can easily slide along the circular race 31, while the bearing pads 106A and 106B can be made of a material that is wear resistant and that allows the shaft 82 to freely rotate about the spin axis 78. Furthermore, the bearing pads 106A and 106B can be replaceable. After the bearing pads 106A and 106B are worn, they can be replaced with new bearing pads to ensure smooth rotation of the shaft 82. Alternatively, after the bearing pads 106A and 106B are sufficiently worn, the pads 106A and 106B can be rotated 180 degrees about the axis 78 relative to the circular race 31.

Figure 9:
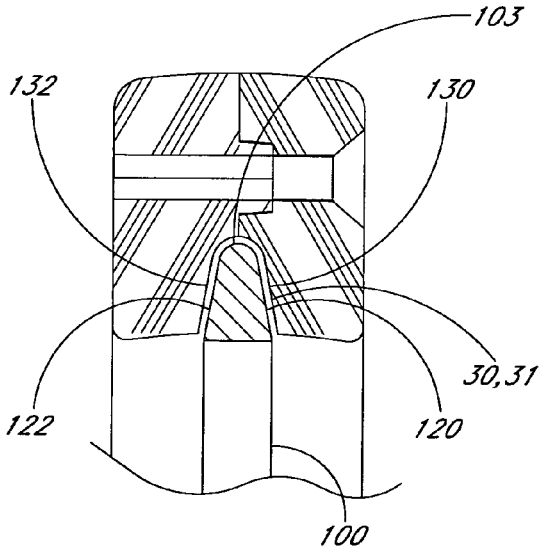
FIG. 9 is an enlarged cross-sectional view the ring guide shown in FIG. 8 mounted in a ring guide of a gyroscopic exercise device in accordance with the present invention.

As shown in FIG. 9, the circular race 31 has a first surface 130 and a second surface 132 and the outer ring portion 103 therebetween. The first surface 120 of the ring guide 100 is substantially parallel to the first surface 130 of the circular race 31. The second surface 122 of the ring guide 100 is substantially parallel to the second surface 132 of the circular race 31. Thus, the radially tapered periphery of the ring guide 100 can mate and slide along the circular race 31. The conically shaped ends of the shaft 82 reduce the wear between the circular race 31 and the shaft 82. There is sufficient traction or friction between both the shaft end 86 and the shaft end 88 and the circular race 31 so that the user can accelerate the rotation of the rotor 80 during operation.

Figure 10:
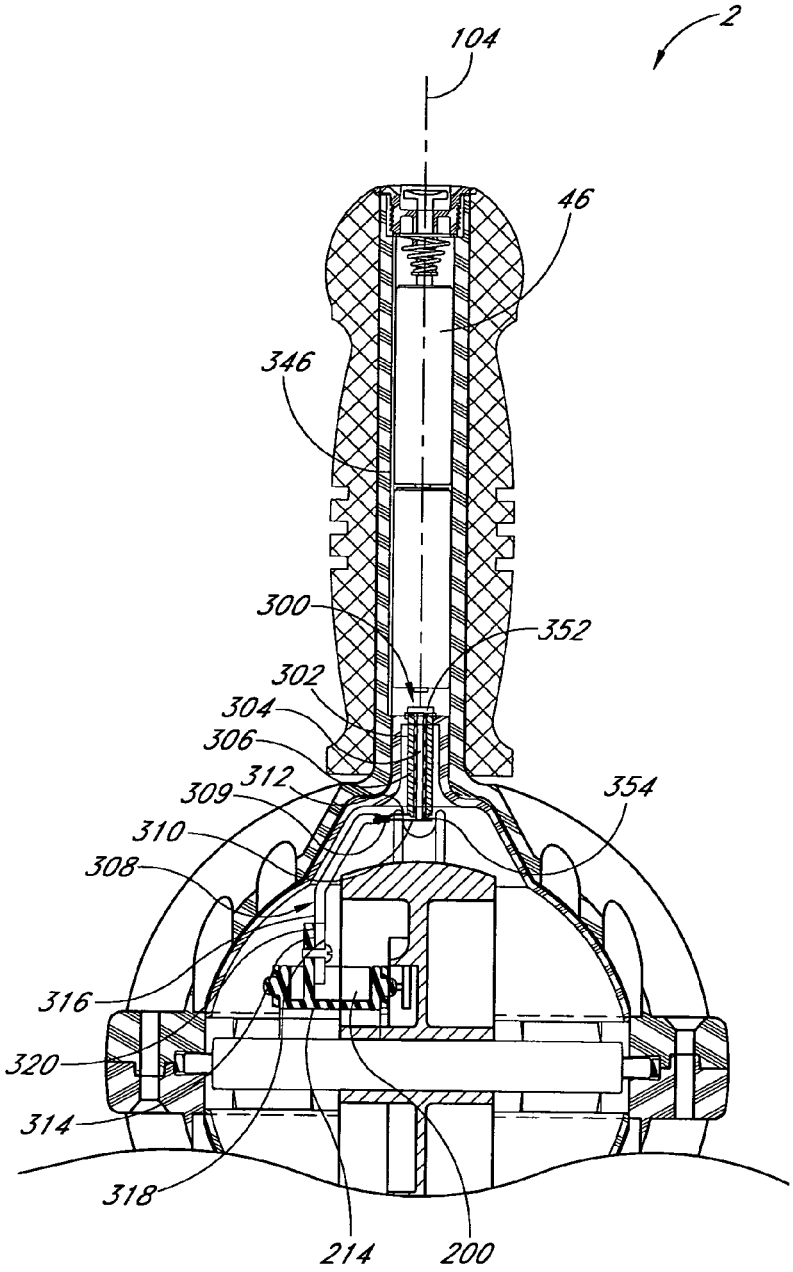
FIG. 10 is a cross-sectional view of a portion of a gyroscopic exercise device having a power supply and power supply conduit shown in FIG. 2.

FIG. 10 shows a portion of the gyroscopic exercise device 2. The device 2 comprises the power supply 46 in communication with the power supply conduit 300 and the conductive contact 308. The power supply conduit 300 comprises an outer, tubular conductive portion 302 surrounding an inner, tubular portion 304 preferably separated by an insulator 306. The contact 352 is at one end of the conductive portion 304 and a contact 354 is at the other end. The contact 354 protrudes from the power supply conduit 300 so that the conductive portion 304 contacts a terminal 310 while the conductive portion 302 contacts a terminal 312. Thus, there is an energy flow between the power supply 46 and the terminal 310 because energy from the power supply 46 can pass through the contact 352, the conductive portion 304, and the contact 354 to the terminal 310.

There is also an energy flow from the terminal 312 to the power supply 46. The conductive portion 302 is in communication with the terminal 312 and a chamber conductor 346. The chamber conductor 346 has one end in communication with the conductive portion 302 and another end in communication with the power supply 46. There is an energy flow between the terminal 312 and the power supply 46 because electrons from the terminal 312 can pass through the conductive portion 302 to the chamber conductor 346, which can pass energy to the power supply 46.

The conductive contact 308 has a terminal 309 that comprises the terminal 310 and 312 that are made of a conductive material and are spaced to prevent electron flow from the terminal 310 directly to the terminal 312. An insulator 311 (shown in FIG. 11) is between the terminal 310 and 312 to inhibit electrons passing between the terminal 310 and the terminal 312. The conductive contact 308 has a conductive contact body 316 between a motor end 314 and the terminal 309. The conductive contact body 316 has a first conduit coupled to one end the terminal 310 for passing energy from terminal 310 the motor 200. The conductive body 316 has second conduit coupled to one end of the terminal 312 for passing energy from the motor 200 to the terminal 312. Thus, the conductive contact 308 provides energy to the motor 200 so that motor 200 can rotate the drive wheel 204, thereby rotating the rotor 80.

The conductive contact 308 is shaped (e.g., curved) to maintain communication with the power supply conduit 300 and the motor 200. The motor end 314 is coupled to the ring guide 100 so that the motor end 314 and the ring guide 100 rotate together about the axis 104 while allowing the rotation of the rotor 80 about the spin axis 78. In the illustrated embodiment, the rotor 80 is between the spin axis 78 and both the terminal 110 and 112. The rotor 80 is also between the motor end 314 of the conductive contact 308 and the axis 104, such that rotor 80 can rotate about the bracket 214. The motor end 314 of the conductive contact 308 is permanently attached to the bracket 214. Those skilled in the art recognize that there are other energy couplers that can be pass energy between the power supply 46 and the motor 200.

The motor end 314 of the conductive contact 308 is in communication with the motor 200 and has a first motor end terminal 318 and a second motor end terminal 320. The conductive contact body 316 defines a path between the terminal 310 and the first motor end terminal 318 and a path between the terminal 312 and the second motor end terminal 320. A conduit, such as wires, can connect the motor 200 the motor end 314.

Figure 11:
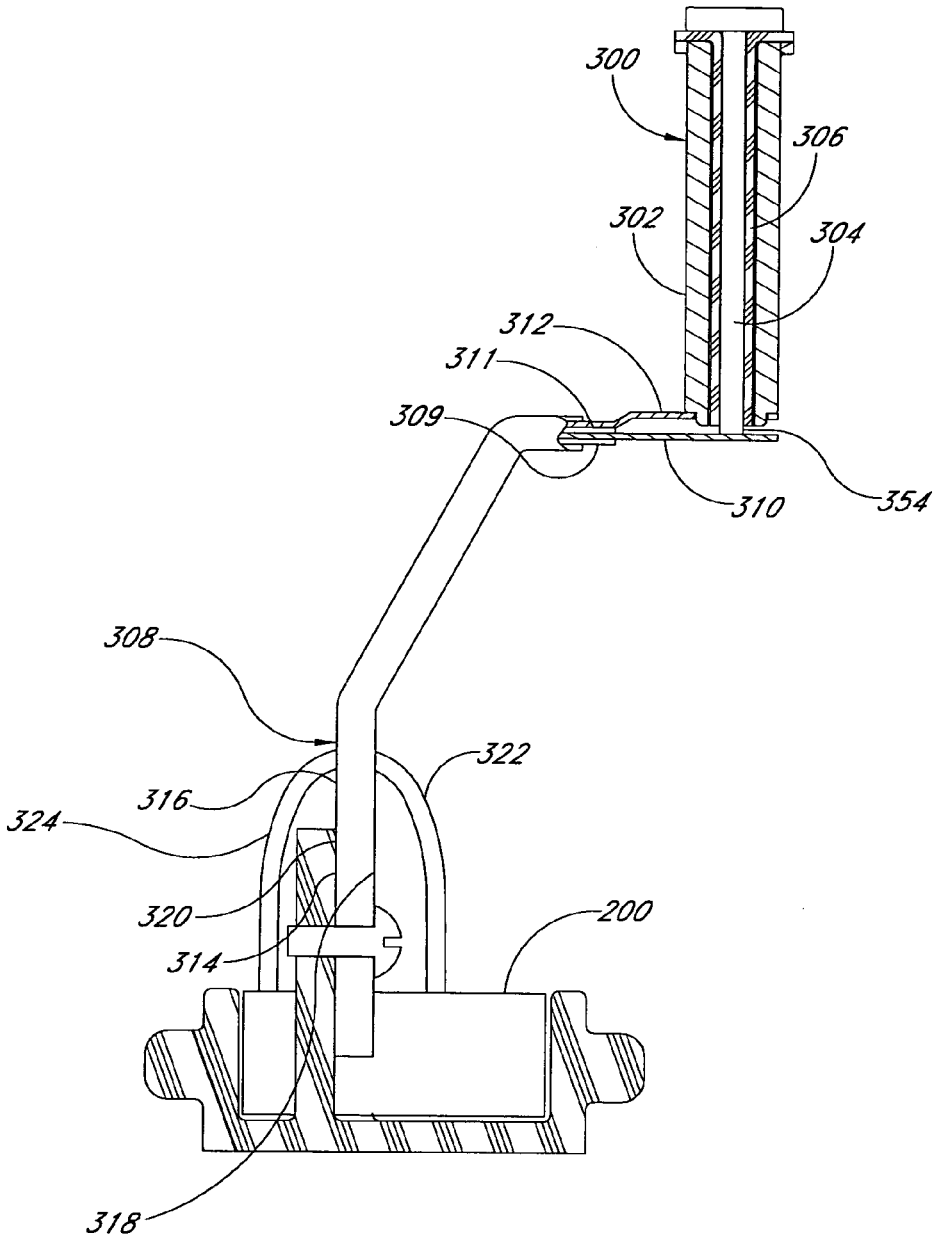
FIG. 11 illustrates a power supply conduit in accordance with a further embodiment of the present invention.

FIG. 11 shows the conductive contact 308 comprising a first conduit, a second conduit, and an insulator between the two conduits. The terminal 310 is at one end of the first conduit and the first motor end terminal 318 is at the other end. The terminal 312 is located at one end of the second conduit and the second motor end terminal 320 is at the other end. The first and the second conduit can be a strip of metal having a substantially uniform thickness. The conductive contact body 316 comprises a portion of the first conduit, a portion of the second conduit, and the insulator between the portion of the first conduit and the portion of the second conduit. The motor 200 can have two terminals where a first conduit 322 (such as a wire) can connect the first motor end 318 to one terminal of the motor 200, and a second conduit 324 (such as a wire) can connect the second motor end 320 to another terminal of the motor 200. Thus, the energy from the terminal 310 can pass through the first conduit to the first motor end 318. The energy can pass through the first wire 322 to the motor 200. Energy from the motor 200 can be passed through the second wire 324 to the second motor end 320. The energy from the second motor end 320 can pass through the second conduit to the terminal 312.

The conducting contact 308 can rotate about the axis 104 as the ring guide 100 rotates about axis 104. Preferably, both the energy flow between the terminal 310 and the contact 354 and the energy flow between the terminal 312 and conductive portion 302 can be maintained as the terminal 310 and the terminal 312 rotate about the axis 104. For example, the conducting contact 308 can apply a force to the terminal 310 to maintain contact between the terminal 310 and the contact 354 while the terminal 310 rotates about the axis 104. Similarly, the conductive contact 308 can apply a force to the terminal 312 to maintain contact between the terminal 312 and the conductive portion 302 while the terminal 312 rotates about the axis 104. In other words, the conductive contact 308 provides a force towards the handle 40 such that terminal 310 maintains contact with the contact 354, and the terminal 312 maintains contact with the conductive portion 302. The aforementioned contacts are maintained while the conductive contact 308 rotates about the axis 104 and while the conductive contact 308 is stationary. In one embodiment, either the terminal 310 or the terminal 312 can have a hole or opening that allows a portion of the power supply conduit 300 to pass through the opening. For example, the contact 354 can pass through a hole formed in terminal 312 and extend to the terminal 310, as shown in FIG. 10.

The power supply 46 provides power (e.g., electricity) to the motor 200. In the illustrated embodiment, the power supply 46 is in the form of a pair of conventional batteries within the chamber 45 of handle 40. The power supply 46 can also be a rechargeable battery (e.g., Nickle-Cadium or Nickle Metal Hydride battery) preferably that can be recharged by the rotation of the rotor 80 and the motor 200, which can function as a generator. Thus the power supply 46 can provide power to the motor 200 and can be recharged as the user operates the device 2. Although not shown there could be power supplies within both the handles 40 and 60.

Figure 12:
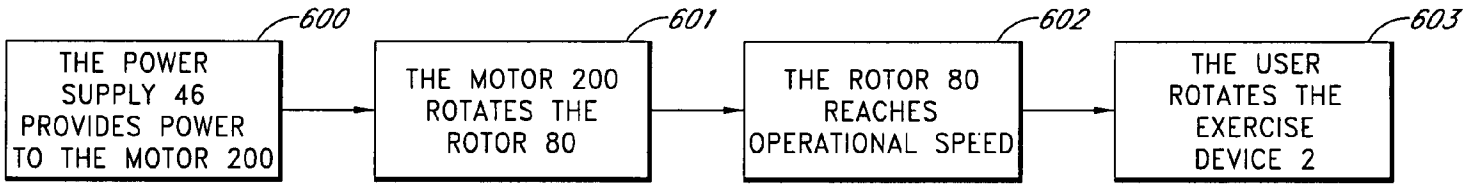
FIG. 12 is a flow chart that outlines the steps in a method of using a gyroscopic exercise device.

In operation, the power supply 46 provides power to the motor 200, which causes rotation of the rotor 80. The rotor 80 rotates at the operational angular velocity so that the user can rotate the handles 40 and the handle 60 causing precession of the rotor 80. The steps of an embodiment are summarized in the flow chart of FIG. 12.

In step 600, the user activates the switch 48 so that power supply 46 provides power to the motor 200. In the illustrated embodiment, the user presses on the switch 48 to activate the switch 48. When the switch 48 is depressed, the power supply 46 contacts the contact 352 and an electrical current flows through the power supply conduit 300 and the conductive contact 308 to the motor 200. The power supply 46 provides energy to the motor 200 while the switch 48 is in the depressed position. Thus, when the user stops pressing on the switch 48, the switch 48 returns to its original position and the power supply 46 does not contact the contact 352, so that electrical current will not flow from the batteries 46 to the motor 200.

In one embodiment, the switch 48 can cause the power supply 46 to provide energy to the motor 200 until the rotor 80 reaches a pre-set angular velocity. The switch 48 can be an manual switch or automatic switch (e.g., a electronic controller). For example, the user can activate the switch 48 in the form of an electronic controller, which allows an electrical current from the power supply 46 to drive the motor 200 for a start-up cycle. After a start-up cycle, the rotor 80 reaches the operational angular velocity. The electronic controller 48 receives a signal from a feedback device, such as velocity sensor 92, and stops the energy flow from the power supply 46 to the motor 200.

In step 601, the device 2 begins a start-up cycle when the motor 200 uses the energy to start rotating the shaft 198, which in-turn rotates the drive wheel 204. The drive wheel 204 contacts and rotates the drive race 90 thereby rotating rotor 80 about the spin axis 78. The power supply 46 can provide power to the motor 200 to increase the angular velocity of the drive wheel 204 to thereby increase the angular velocity of the rotor 80. The angular velocity of the rotor 80 is increased until the end of the start-up cycle, preferably when the rotor 80 rotates at the operational angular velocity, such that the user can operate the device 2.

In step 602, the rotor 80 achieves the operational angular velocity. After the rotor 80 rotates at the operational angular velocity, the user can stop the power flow from the power supply 46 to the motor 200. The rotor 80 can continue to rotate about the spin axis 78 such that the user can grip the handle 40 with one hand and grip the handle 60 with the other hand.

Figure 13:
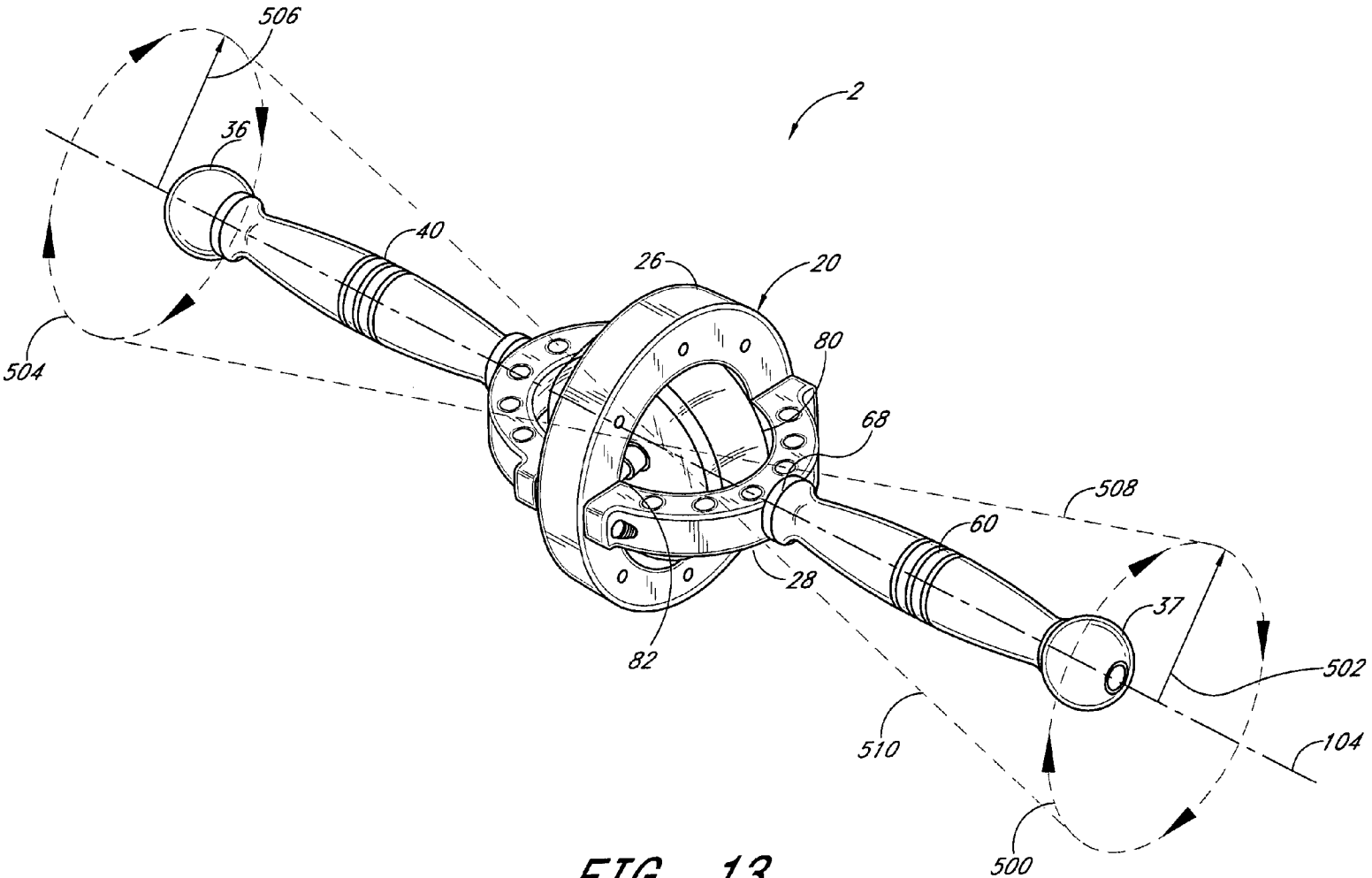
FIG. 13 is a perspective view of a gyroscopic exercise device in operation in accordance with the present invention.

In Step 603, while rotor 80 is rotating about the spin axis 78, the user can manually move the device 2 in a gyration motion causing precession of the rotor 80. The precession of the rotor 80 provides resistance, a torque, to the user. The user can gyrate the device 2 so that the user feels either a reasonably constant resistance or a varying resistance. For example, the user can start to rotate the device 2, as shown in FIG. 13, by rotating the handles 40 and 60 along a cone-like path. The outer end portion 36 of the handle 40 is rotated along a path 504, which is in a plane perpendicular to the axis 104, in a direction indicated by the arrows along the path 504. The outer end portion 37 of the handle 60 is rotated along a path 500, which is in a plane perpendicular to the axis 104, in the direction indicated by the arrows along the path 500. In the illustrated embodiment, the longitudinal axis 54 of the handle 40 and the longitudinal axis 66 of the handle 60 travel along a cone-like path, as shown in FIG. 13 by the dashed lines segments 508, and 510. Preferably, the user gyrates the device 2 in the range of 60 rpm to 250 rpm. The path 500 and 504 can be an orbital path, such as a curved path, generally circular path, elliptical path, or the like. Further, the rotor 80 precesses about the axis 104 in the same direction as the direction of the outer end portions 36 and 37. Of course, the user can rotate the outer end portion 36 in the direction opposite of the arrows along path 504 while the user can rotate the outer end portion 37 in the direction opposite of the arrows along path 500.

Because the rotor 80 precesses when the user applies a moment perpendicular to the spin axis 78 and the axis 104 (precession axis), the user can use a generally rocking motion to cause precession of the rotor 80. For example, the outer end portion 36 can be translated along a first line and the outer end portion 37 can be translated along a second line, which is parallel to the first line. Preferably, the first line and the second line are perpendicular to the axis 104, and the user applies a moment to device 2 about an axis that is not coaxial with the spin axis 78.

The rotation of the device 2 causes the precession of the rotor 80. In the illustrated embodiment, the axis 104 is perpendicular to the plane passing through circular race 31. Thus, the spin axis 78 and the precession axis are perpendicular. As the user makes the aforementioned movements, the ring guide 100 and the rotor 80 start to rotate about the precession axis (i.e., axis 104) because the user applies a moment to the axis perpendicular to the spin axis 78 and the precession axis. Thus, the rotor 80 rotates about the spin axis 78 while the spin axis 78 rotates in the plane perpendicular to the axis 104. While the rotor 80 precesses, the shaft ends 86 and 88 roll along the circular race 31, and the ring guide 100 slides along the circular race 31. Because the ends 86 and 88 are located in the notch 96 and the notch 98, respectively, the shaft 82 and the ring guide 100 rotate together about the axis 104. Thus, the shaft 82, the rotor 80, the ring guide 100, the motor 200, the drive wheel 204 rotate together about the axis 104, preferably while the rotor 80 is rotating about the spin axis 78. The user's motion can increase, decrease, or maintain the angular velocity of rotor 80 about the spin axis 78 and the precession speed of the rotor 80.

The device 2 can be used in various manners for resistance and cardiovascular training. The user can exercise with the device 2 by rotating the device 2 while maintaining the location of the centriod of the rotor 80. Alternatively, the user can exercise with the device 2 by simultaneously translating and rotating the device 2 to work-out various muscles, such as the user's biceps, triceps, an deltoids. The user can rotate the device 2 while performing a biceps curl. The user can perform different motions to provide desired resistance to various muscles. Muscles on the user's left and right side of the body can be exercised simultaneously for a time efficient work-out. For example, while the user rotates the device 2 causing rotor 80 recession, the user can perform biceps curls. The resistance to the user can be varied, for example, by varying the radius 502 and the radius 506 and/or the speed of the handle end portion 36 along the path 504 and the speed of the handle end portion 37 along the path 500. Of course, the inertia of the rotor 80 can be varied to change the resistance. For example, the resistance to the user can be increased by forming the rotor 80 from a heavier material or by increasing the moment of inertia of the rotor 80.

The user can rotate the device 2 for resistance and cardiovascular training without having to move their legs. For example, the device 2 can be used while the user is in a sitting position or laying down in bed. The training with device 2 can be performed for an extended period of time, because the user can maintain a smooth rotational motion of the device 2 by using different muscles of the user's body (e.g., back muscles, deltoids, pectorals, biceps, and triceps). Additionally, the device 2 can be used in most indoor settings so that the user can train when the outside environment is not suitable for exercising, such as running or walking. Because the device 2 is used to exercise various large muscle groups simultaneously, the user can obtain vigorous resistance and cardiovascular exercise.

The device 2 can be also be used with other devices. For example, a holding frame can be used to hold the device 2. The holding frame can hold the device 2 over the user who is laying in bed while the user rotates the device 2. The frame can ensure that the user properly rotates the device 2 for the desired work-out.

The device 2 can provide resistance to the user even in a gravity free environment. The device 2 can be used, e.g., in outer space because the mass of the precessing rotor provides resistance to the user. Many of the muscles in the user's upper body are used to gyrate the device 2 and the user can increase the gyration of the exercise device for an increased cardiovascular work-out.

While particular forms of the invention have been described, it will be apparent that various modifications can be made without departing from the spirit and scope of the invention. Accordingly, it is not intended that the invention be limited, except as by the appended claims.

What is claimed is:

1. A gyroscopic exercise device, comprising:

a housing;

a pair of handles coupled to the housing;

a gyroscope within the housing;

a drive wheel that rotates the gyroscope;

a motor having a shaft which is coupled to the drive wheel;

a conductive contact having a power supply end and a motor end, the conductive contact rotates about an axis that passes through the power supply end; and a power supply in communication with the power supply end of the conductive contact, the motor end of the conductive contact being in communication with the motor, the power supply being capable of providing energy through the conductive contact to the motor.

2. The device of claim 1, wherein the power supply is located in one of the handles and includes a battery.

3. The device of claim 1, wherein the power supply is a battery, and the power supply end of the conductive contact has a pair of terminals in communication with the power supply.

4. A gyroscopic exercise device, comprising:

a housing having an annular path;

a first handle coupled to one side of the housing;

a second handle coupled to an opposite side of the housing;

a shaft having a first end and a second end and a first axis, the shaft rotatably coupled to the housing about the first axis, the first end and the second end rotatably mounted in the annular path; and a rotor coupled to the shaft between the first end and the second end of the shaft;

a power supply;

a drive assembly within the housing comprising a motor for spinning the rotor; and a conductive conduit having a power terminal at one end and a drive terminal at the other end, the power terminal receives energy from the power supply, the drive terminal provides energy to the drive assembly, the conductive conduit rotates as the drive assembly rotates.

* * * * *